US006086190A

United States Patent [19]

Schantz et al.

[11] Patent Number: 6,086,190

[45] Date of Patent: Jul. 11, 2000

[54] LOW COST INK DROP DETECTOR

[75] Inventors: Christopher A. Schantz, Redwood City; Paul R. Sorenson, San Diego, both of Calif.

[73] Assignee: Hewlett-Packard Company, Palo Alto, Calif.

[21] Appl. No.: 08/946,190

[22] Filed: Oct. 7, 1997

[51] Int. Cl.[7] ..... B41J 2/125

[52] U.S. Cl. ..... 347/81

[58] Field of Search ..... 347/6, 81, 74, 347/19

[56] References Cited

U.S. PATENT DOCUMENTS

| | | | |
|---|---|---|---|
| 4,067,019 | 1/1978 | Fleischer et al. | 346/75 |
| 4,128,841 | 12/1978 | Brown et al. . | |
| 4,310,846 | 1/1982 | Horike . | |
| 4,323,905 | 4/1982 | Reitberger et al. . | |
| 4,333,083 | 6/1982 | Aldridge | 347/81 |
| 4,636,809 | 1/1987 | Eremity | 347/90 |
| 4,878,064 | 10/1989 | Katerberg et al. | 347/78 |
| 5,036,340 | 7/1991 | Osborne | 347/19 |
| 5,325,112 | 6/1994 | Muto | 347/19 |

FOREIGN PATENT DOCUMENTS 0334546 9/1989 European Pat. Off. .

*Primary Examiner*—Robert Beatty

[57] ABSTRACT

An ink drop detector that minimizes costs of a printer by employing preexisting digital signal processing elements in a printer and low cost analog sensing elements. The analog sensing elements are tuned to ink drop bursts, which include a plurality of ink drops, and the preexisting digital signal processing elements extract ink drop characterization information from sensed analog signals.

26 Claims, 3 Drawing Sheets

LOW COST INK DROP DETECTOR

BACKGROUND OF THE INVENTION

1. Field of Invention

The present invention pertains to the field of printers. More particularly, this invention relates to a low cost ink drop detector.

2. Art Background

Prior printers including black and white printers and color printers commonly include one or more print heads that eject ink drops onto paper. Such a print head usually includes multiple nozzles through which ink drops are ejected. Typically, a print head ejects ink drops in response to drive signals generated by print control circuitry in the printer. A print head that ejects ink drops in response to drive signals may be referred to as a drop on demand print head.

One type of drop on demand print head employs piezo-electric crystals that squeeze out ink drops through nozzles in the print head in response to the drive signals. Another type of drop on demand print head employs heating elements that boil out ink drops through nozzles in the print head in response to the drive signals. Such print heads may be referred to as thermal ink jet print heads.

Typically, the nozzles through which ink drops are ejected can become clogged with paper fibers or other debris during normal use or clogged with dry ink during prolonged idle periods. Prior printers commonly include mechanisms for cleaning the print head and removing the debris. Such a mechanism may be referred to as print head service station and may include mechanisms for wiping the print head and applying suction to the print head to clear out any blocked nozzles.

Prior printers typically lack a mechanism for determining whether the print head actually requires cleaning. Such printers usually apply the service station to the print head based on a determination of whether the print head may possible require cleaning. Unfortunately, such printers must then employ over cleaning which usually slows the overall printing throughput.

It would be desirable to provide a printer with a mechanism for detecting whether ink drops are being ejected from the print head. Such a mechanism could be used to determine whether a print head actually requires cleaning. In addition, a mechanism for detecting ink drops could be used to detect permanent failures of individual nozzles which may be caused, for example, by failures of heating elements in a thermal ink jet print head.

One possible method for detecting the ejection of ink drops from a print head is to equip the printer with a drop detection station that employs piezo-electric material and associated circuitry which detects the impact of the ink drops hitting the detection station. Unfortunately, such piezo-electric material is relatively expensive and adds to the manufacturing cost of a printer. In addition, such a mechanism usually cannot detect extremely small ink drops as are used in high resolution and color printers. Moreover, piezo-electric material typically loses sensitivity as ink accumulates on its surface thereby reducing its ability to detect ink drop impacts.

Another possible solution is to equip the printer with an optical detector that includes a light source and a detector. Typically, an ink jet nozzle must be aimed so that ink drops pass between the light source and the detector and occlude light rays that travel between the light source and the detector. Unfortunately, the circuitry for such an optical detector is usually expensive and therefore adds to the manufacturing cost of a printer. In addition, such a technique usually requires very fine control over the positioning of the optical detector with respect to nozzles being tested. Moreover, mist or spray from the nozzle can contaminate the optical detector and cause reliability problems.

Another possible solution which is specific to thermal ink jet print heads is to equip the print head itself with an acoustic detector. Typically, such an acoustic drop detector detects the shock wave associated with the collapse of ink bubbles in the print head. Unfortunately, such ink bubble shock waves may occur even though ink is not being ejected from the print head. In addition, acoustic measurements can be corrupted by large current pulses that occur during printer operation. Moreover, the acoustic detector and associated signal amplifier circuitry for such an acoustic detector is usually expensive and increases the overall manufacturing costs of a printer.

SUMMARY OF THE INVENTION

An ink drop detector is disclosed that minimizes costs of a printer by employing preexisting digital signal processing elements and low cost analog sensing circuitry. The sensing circuitry includes a sensing element which is imparted with an electrical stimulus when struck by a series of ink drop bursts ejected from a print head. The sensing circuitry also includes a sense amplifier which is tuned to a frequency or frequencies at which the ink drop bursts are ejected from the print head. The sense amplifier generates an output signal in response to the ink drop bursts striking the sensing element. A processor in the printer determines an amplitude of the output signal at the frequency or frequencies at which ink drop bursts are ejected. The amplitude indicates a characteristic of the ink drops in each burst and has a variety of applications.

Other features and advantages of the present invention will be apparent from the detailed description that follows.

BRIEF DESCRIPTION OF THE DRAWINGS

The present invention is described with respect to particular exemplary embodiments thereof and reference is accordingly made to the drawings in which.

DETAILED DESCRIPTION

Figure 1:
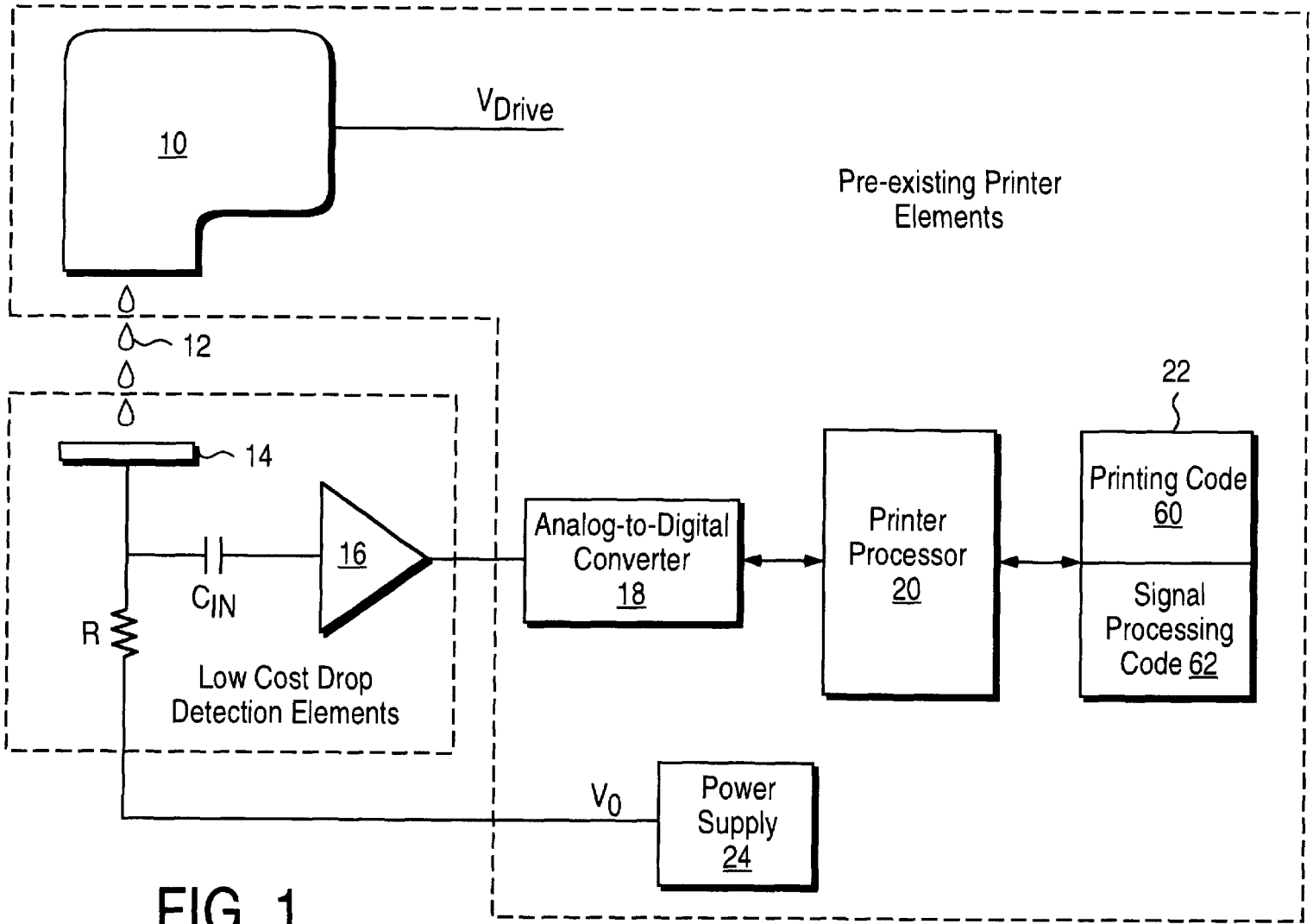
FIG. 1 illustrates a low cost ink drop detector which employs preexisting digital signal processing elements in a printer along with low cost analog sensing elements.

FIG. 1 illustrates a low cost ink drop detector which employs preexisting digital signal processing elements in a printer along with low cost analog sensing elements. The preexisting digital signal processing elements include an analog-to-digital converter 18, a printer processor 20, and a memory 22. The low cost analog sensing elements include an electrostatic sensing element 14 and a sense amplifier 16.

The digital signal processing capability provided by the preexisting elements in the printer enables the use of a relatively low sensitivity, low speed and therefore low cost implementation of the sense amplifier 16. The digital signal processing enables the extraction of a reliable drop detection value from the low cost amplifier even though the output signal of the low cost amplifier may be lower than its electrical noise.

A print head 10 is positioned opposite the sensing element 14 at a distance of several millimeters during ink drop detection. In one embodiment, the print head 10 is positioned 3 millimeters away from the sensing element 14. The sensing element 14 may be disposed in an existing service station in the printer. The sensing element 14 is applied with a voltage potential $V_0$ by a power supply 24. The print head 10 is applied with a drive voltage $V_{DRIVE}$ for actuating the ink drop firing mechanisms of its nozzles. The voltage potential $V_{DRIVE}$ applied to the print head 10 is relatively low compared to $V_0$. For example, in one embodiment, $V_{DRIVE}$ is approximately 5 volts and the power supply 24 applies a $V_0$ of approximately 100 volts. This results in an electric field between the print head 10 and the sensing element 14 of approximately 30 volts/millimeter.

The print head 10 ejects a series of ink drops 12 during an ink drop test cycle. The relatively high electric field between the print head 10 and the sensing element 14 cause the accumulation of electrical charge in the portions of the ink drops 12 closest to the sensing element 14 as they shear away from a nozzle of the print head 10. As each of the ink drops 12 separates from the print head 10 it retains its accumulated electrical charge. Each of the ink drops 12 thus transports its induced charge to the sensing element 14.

As a consequence, each of the ink drops 12 imparts a spike or pulse of electrical charge onto the sensing element 14 as it makes contact. These spikes or pulses on the sensing element 14 are AC coupled through an input capacitor $C_{IN}$ to an input of the sense amplifier 16. The sense amplifier 16 generates an output signal 40 in response to the electrical voltage imparted onto the sensing element 14 by the bursts of the ink drops 12. The sense amplifier 16 amplifies the pulses and provides some filtering.

The sense amplifier 16 is a relatively low cost amplifier which does not have enough sensitivity or speed to detect individual ones of the ink drops 12. In one embodiment, the sense amplifier 16 is realized with a two-stage single supply operational amplifier implemented on a CMOS integrated circuit chip. The first stage is AC coupled to the sensing element 14 and converts the electrical current imparted to the sensing element 14 by the ink drops 12 into a voltage. The second stage provides voltage amplification of the first stage voltage output to provide the output signal 40. The gain of the second stage is set such that a 1 millisecond current pulse of 200 pico-amps at the input to the first stage results in a 2.5 volt pulse of the output signal 40.

In order to compensate for the low sensitivity and speed of the sense amplifier 16, the ink drops 12 are fired in a series of bursts having a predetermined frequency or pattern of frequencies. The sense amplifier 16 is tuned to amplify signals from the sensing element 14 at the frequency or frequencies of the predetermined pattern. The output signal 40 from the sense amplifier 16 is provided to an analog-to-digital converter 18 which generates a digitized version. This digitized version of the output signal 40 is provided to the printer processor 20 which executes signal processing code 62.

The printer processor 20 when executing the signal processing code 62 performs a digital signal processing function on the digitized version of the output signal 40. The digital signal processing function performed by the printer processor 20 determines a magnitude of the output signal 40 at the predetermined frequency or pattern of frequencies at which ink drops are ejected from the print head 10. This magnitude provides a drop detection value that is then used to characterize ink drops ejected from the print head 10 during an ink drop test cycle. One characteristic which the drop detection value is used to determine is whether any ink drops were ejected during the ink drop test cycle. Another characteristic is the volume of the ink drops ejected during the ink drop test cycle. Another characteristic is the velocity of the ink drops ejected during the ink drop test cycle.

Figure 2:
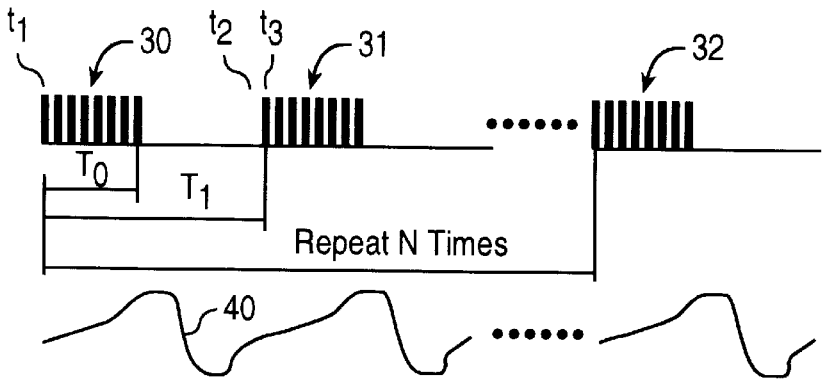
FIG. 2 illustrates an example series of ink drop bursts which are fired from the print head during an ink drop test cycle.

FIG. 2 illustrates an example pattern of ink drop bursts 30–32 which are fired from the print head 10 during an ink drop test cycle. Each of the bursts 30–32 includes a series of eight ink drops. In one embodiment, each of the bursts 30–32 has a duration of $T_0$ and a period of $T_1$. The total number of the bursts 30–32 in an ink drop test cycle is equal to N. In this embodiment, the predetermined frequency of the bursts 30–32 is $1/T_1$ throughout the duration of an ink drop test cycle.

In one example, $T_0$ is 0.8 milliseconds and T1 is 1.6 milliseconds which yields a 50 percent duty cycle. The predetermined frequency of the bursts 30–32 is 1/1.6 milliseconds or 625 hertz. The rate of firing of individual ink drops during each of the bursts 30–32 is 10 kilohertz. For this embodiment, the sense amplifier 16 is tuned to 625 hertz which is relatively slow compared to the 10 kilohertz rate of nozzle firing from the print head 10.

A waveform 40 represents the output signal 40 of the sense amplifier 16 in response to the bursts 30–32. The waveform 40 has a periodic shape roughly corresponding to the frequency of the bursts 30–32. The analog-to-digital converter 18 samples the waveform 40 several times during each cycle of the waveform 40 at equal time intervals. For example, the analog-to-digital converter 18 begins sampling the waveform 40 at time t1 and completes a sample cycle at time t2 which is just before the start of the burst 31. The analog-to-digital converter 18 then begins sampling the next cycle of the waveform 40, which corresponds to the burst 31, at time t3 and so on.

In another embodiment, the bursts 30–32 are ejected from the print head 10 in a predetermined pattern of frequencies. Such a predetermined pattern may be a shifting pattern of frequencies. For example, the frequency of the bursts 30–32 may shift from 500 hertz to 525 hertz to 550 hertz and back again to 500 hertz in a repeating pattern. Each frequency in the shifting pattern is within the frequency response range of the amplifier 16. The shifting pattern of frequencies avoids errors that may be caused by a condition in which a particular frequency of the bursts 30–32 matches a frequency of noise that exists in the environment of the printer. The shifting pattern makes it likely that one or more of the frequencies in the pattern will be clear of the noise and be useable for rendering a drop detection value. It is preferable that the frequencies in the shifting pattern not be multiples of each other. It is also preferable that the frequencies in the shifting pattern not be harmonics of each other.

Figure 3:
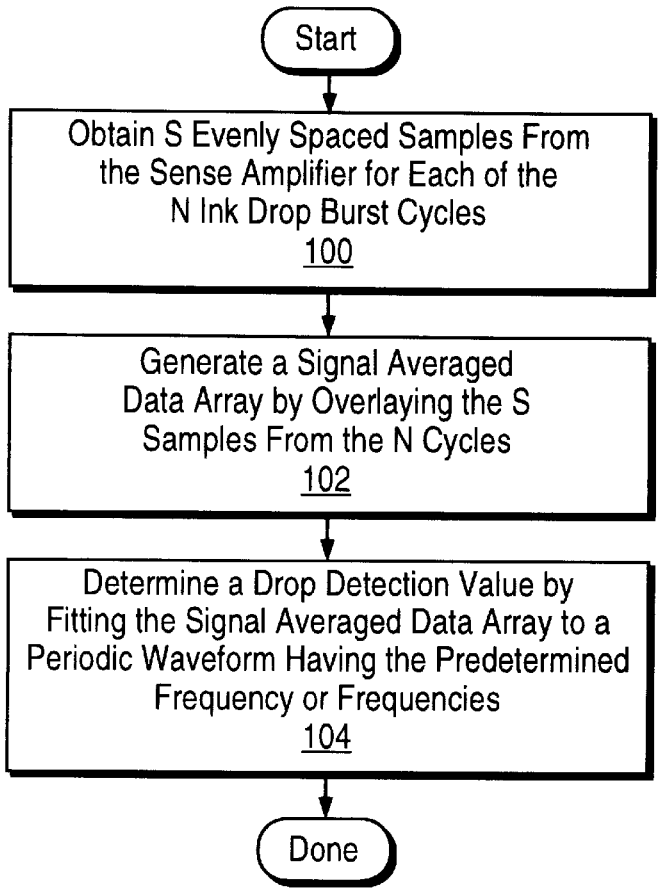
FIG. 3 illustrates the digital signal processing steps performed by the printer processor.

FIG. 3 illustrates one embodiment of the digital signal processing steps performed by the printer processor 20 when executing the signal processing code 62. At step 100, the printer processor 20 uses the analog-to-digital converter 18 to obtain S digitized samples for each of the N cycles of the output signal 40 from the sense amplifier 16. At step 102, the printer processor generates a signal averaged data array by overlaying the S samples for each of the N cycles of the output signal 40 and generating an average value for each of the S samples. The averaged values in the signal averaged data array eliminate noise in the output signal 40. The signal averaged data array contains S averaged values.

At step 104, the printer processor 20 determines a drop detection value from the signal averaged data array by fitting the data array to a target waveform having a frequency equal to the predetermined frequency of the bursts 30–32. In one embodiment, the signal averaged data array is fit to a function having the following form:

$$A\sin(\omega t+\theta)$$

The amplitude A provides the drop detection value which is the amplitude of the output signal 40 at the predetermined frequency of the bursts 30–32 which is ω. In the example above, ω is equal to 625 Hz. The phase angle θ is a characteristic of the particular implementation of the sense amplifier 16 and in one embodiment determined by measurement and stored for the printing processor 20. Alternatively, the phase angle θ can be derived as a variable in the same manner as the amplitude A.

In another embodiment, the target waveform is a square wave having the predetermined burst cycle frequency. In another embodiment, the target waveform is an experimentally derived waveform that matches the actual measured response of the sense amplifier 16.

In yet another embodiment, the printer processor 20 extracts the drop detection value from the data array by multiplying the data array by a sine array and a cosine array, then summing the results and then taking the square root of the sum of the squares according to the following equation:

$$\text{Value} = \sqrt{\left(\sum_{n=0}^{S-1}\right)\left(D_{(n)} * \sin\left(\frac{2\pi n}{S-1}\right)\right) + \sum_{n=0}^{S-1}\left(D_{(n)} * \cos\left(\frac{2\pi n}{S-1}\right)\right)\Bigg)}$$

where $$D_{(n)} = \sum_{m=1}^{N} D_{(n)} + D_{((m*S)+n)}$$

The printer processor 20 is provided with lookup tables that contain the values for the sine and cosine arrays.

In another embodiment, the digital signal processor 20 performs a fast fourier transformation (FFT) on the digitized version of the output signal 40 and then extracts the amplitude at the frequencies of interest, namely the predetermined frequency of the bursts 30–32.

The resulting drop detection value at step 104 is proportional to the number of drops fired from the print head 10. The resulting drop detection value is also proportional to the volume of the ink drops ejected and the velocity of the ink drops that were ejected depending upon which characteristic is being determined. For example, the drop detection value is a linear function of the number of ink drops in each of the bursts 30–32, the number of nozzles fired during each of the bursts 30–32, and the bias voltage $V_0$ applied to the sensing element 14 if the velocity and volume of ink drops remain constant.

In an embodiment in which the bursts 30–32 are arranged in a predetermined pattern of frequencies the step of signal averaging may be minimized or skipped. A drop detection value is determined for each of the frequencies in the predetermined pattern of the bursts 30–32 using the techniques described above or their equivalents. For example, a data array may be generated for each frequency in the predetermined pattern and a waveform matching step may be performed on each of the data arrays. The resulting drop detection values are then used for a variety of determinations as described hereinafter.

Figure 4:
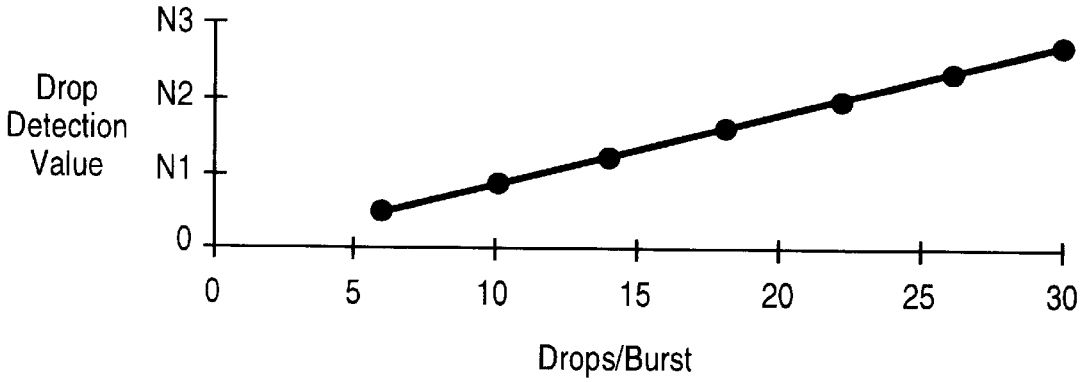
FIG. 4 is a graph showing the drop detection value verses the number of ink drops contained in each of the bursts of an ink drop test cycle.

FIG. 4 is a graph showing the drop detection value verses the number of ink drops contained in each of the bursts 30–32 of an ink drop test cycle. The graph shows the advantage of using ink drop bursts having multiple ink drop firings given the relatively low sensitivity of the sense amplifier 16. For example, the sense amplifier 16 yields a low output at the frequency of interest as shown by the graph when 5 or fewer drops are included in each of the bursts 30–32.

The values in this graph are stored by the printer processor 20 for subsequent use when detecting ink drops or characterizing ink drops ejected from the print head 10. The data for this graph may be preprogrammed into a table in the signal processing code 62 at the time of manufacture or the printer processor 20 may gather the data at any time after manufacture.

The printer processor 20 compares the drop detection value or values obtained from a ink drop test cycle to the stored representation of this graph to determine the number of drops fired by the print head 10 during the ink drop test cycle. For example, if the drop detection value from an ink drop test cycle is within a tolerance value of the number N1, then it can be concluded that 10 ink drops struck the sensing element 14 during each the bursts 30–32. If the drive control electronics for the print head 10 actuated 10 firings per burst then it can be concluded that the particular nozzle of the print head 10 under test is functioning properly. If, on the other hand, the drive control electronics actuated 10 firings and the resulting drop detection value is significantly below N1 then it can be concluded that the particular nozzle under test is not functioning properly.

The drop detection values is useful for rendering a go/no-go decision on each of the nozzles in the print head 10. For example in one embodiment, the printer processor 20 opportunistically tests a few nozzles on the fly at the end of a print cycle on a page. If the drop detection value from a particular ink drop test cycle is too low then the printer applies the print head 10 to the service station in the printer. If after cleaning several times the particular nozzle or nozzles are still bad then the printer processor 20 can adjust its printing algorithm embodied in the printing code 60 to compensate for the bad nozzle or provide an error indication to a user of the printer that the print head 10 should be replaced.

The drop detection value is also useful for characterizing the individual nozzles of the print head 10 in order to enhance gray scale or color resolution. For example, the printer processor 20 can obtain cumulative drop detection values for each of the nozzles of the print head 10. This per nozzle drop detection data may be used to estimate the size or volume of the individual drops ejected by particular nozzles in the print head 10 on a per nozzle basis. The volume of ink drops from individual nozzles can vary due to process variation during manufacture of the print head 10. The volume of ink drops from a particular nozzle may also vary over time as the print head 10 is in extended use. The printer processor 20 can use the per nozzle drop detection data to adjust the numbers of ink drops ejected from particular nozzles for a desired gray scale level.

The drop detection value is also useful for adjusting the drive voltages to individual ones or groups of nozzles in a thermal print head in order to enhance the life of the heating elements contained therein. Process control variations during manufacture of a thermal print head can cause certain ones of the nozzles to fire at higher or lower drive voltages that others. In addition, groups of nozzles may require higher drive voltages due to bussing variation in a thermal print head as well as process control variations among the nozzles. Moreover, these turn on energy levels for individual nozzles can vary over time with extended use of the thermal print head. The printer processor 20 could conduct firing trials on individual nozzles or groups of nozzles to detect the minimum level of drive voltage required to fire ink drops. During these trials the printer processor 20 varies the drive voltages or the pulse width of the drive voltages until the drop detection value indicates optimum drive conditions for a particular nozzle. The printer processor 20 selects a minimum voltage operating point that will extend the life of the heating elements in the thermal print head.

Figure 5A:
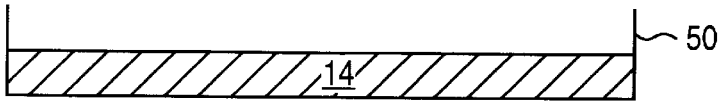
FIGS. 5*a*–5*c* illustrate various example configurations for the sensing element.
Figure 5B:
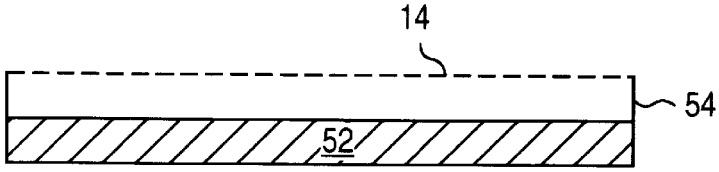
Figure 5C:
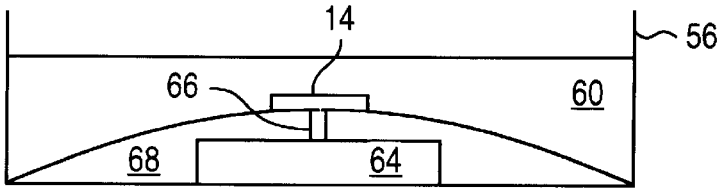

FIGS. 5*a*–5*c* show various configurations for the sensing element 14. In each configuration the sensing element is contained in a trough or spittoon that accepts test ink drops fired from the print head 10. The spittoon prevents test ink drops from contaminating other parts of the printer. The spittoon may be an existing spittoon in the service station of a printer or may be an additional spittoon provided for ink drop detection.

FIG. 5*a* shows the sensing element 14 as a layer of electrically conductive plastic foam disposed in a spittoon 50. The foam layer 14 is compressible and absorbs ink drops to prevent printer contamination. The layer 14 is electrically coupled to the input capacitor $C_{IN}$ for the sense amplifier 16 by an electrical signal line (not shown).

FIG. 5*b* shows the sensing element 14 as a grid of fine stainless steel wire positioned at the opening of a spittoon 54. The stainless steel wire 14 is electrically coupled to the input capacitor $C_{IN}$ for the sense amplifier 16 by an electrical signal line (not shown). The spittoon 54 contains a layer 52 of non-conductive foam that absorbs the test ink drops.

FIG. 5*c* shows an application specific integrated circuit (ASIC) 64 contained in the trough of a spittoon 54. The ASIC 64 implements the circuitry of the sense amplifier 16. The ASIC 64 is encapsulated by an insulating layer 68. The sensing element 14 is a metal layer disposed on top of the insulating layer 68 and is electrically coupled to circuitry on the ASIC 64 through a via 66 through the insulating layer 68. A layer 60 of insulating foam covers the trough of the spittoon 56.

In an alternative to placement in a spittoon of a service station, the sensing element 14 may be positioned beneath a paper path in a printing area opposite the print head 10. Such a sensing element 14 may be constructed of a conductive pad of foam or a metallic or a conductive plastic member.

The foregoing detailed description of the present invention is provided for the purposes of illustration and is not intended to be exhaustive or to limit the invention to the precise embodiment disclosed. Accordingly, the scope of the present invention is defined by the appended claims.

What is claimed is:

1. An ink drop detector, comprising:

sensing element which is imparted with an electrical stimulus when struck by each ink drop in a series of ink drop bursts to be ejected from a print head, each ink drop burst comprising a plurality of ink drops;

sense amplifier coupled to the sensing element, the sense amplifier tuned to a frequency at which the ink drop bursts are to be ejected from the print head;

processing means that determines an amplitude of an output signal generated by the sense amplifier at the frequency at which the ink drop bursts are to be ejected such that the amplitude indicates a characteristic of the ink drops ejected during each burst.

2. The ink drop detector of claim 1, wherein the processing means determines the amplitude by performing a digital signal processing function on the output signal.

3. The ink drop detector of claim 1, wherein the characteristic is whether any ink drops were ejected during each burst.

4. The ink drop detector of claim 1, wherein the characteristic is the volume of the ink drops in each burst.

5. The ink drop detector of claim 1, wherein the characteristic is the velocity of the ink drops in each burst.

6. An ink drop detector, comprising:

sensing element which is imparted with an electrical stimulus when struck by each ink drop in a series of ink drop bursts to be ejected from a print head;

sense amplifier coupled to the sensing element, the sense amplifier tuned to a frequency at which the ink drop bursts are to be ejected from the print head;

processing means that determines an amplitude of an output signal generated by the sense amplifier at the frequency at which the ink drop bursts are to be ejected such that the amplitude indicates a characteristic of the ink drops ejected during each burst, wherein the processing means determines the amplitude by digitizing the output signal to generate a data array and then matching the data array to a target waveform having the frequency.

7. The ink drop detector of claim 6, wherein the target waveform is a sine wave having the frequency.

8. The ink drop detector of claim 6, wherein the target waveform is a square wave having the frequency.

9. The ink drop detector of claim 6, wherein the target waveform is an experimentally derived waveform that matches a frequency response of the sense amplifier.

10. The ink drop detector of claim 1, wherein the processing means includes a preexisting processor and a preexisting analog-to-digital converter in a printer that contains the print head.

11. The ink drop detector of claim 1, wherein the sensing element is contained a spittoon.

12. The ink drop detector of claim 1, wherein the sensing element is positioned in a printing area opposite the print head.

13. A method for detecting ink drops from a print head, comprising the steps of:

generating an electrical signal in response to each of a series of bursts of ink drops from the print head;

sensing and amplifying the electrical signals to generate an output signal at a frequency at which the bursts are ejected from the print head, each burst comprising a plurality of ink drops;

determining an amplitude of the output signal at the frequency by performing a digital signal processing function on the output signal such that the amplitude indicates a characteristic of the ink drops in each burst.

14. The method of claim 13, wherein the characteristic is whether any ink drops are being ejected from the print head during each burst.

15. The method of claim 13, wherein the amplitude indicates a volume of the ink drops ejected by the print head during each burst.

16. The method of claim 13, wherein the amplitude indicates a velocity of the ink drops ejected by the print head during each burst.

17. The method of claim 13, wherein the amplitude indicates a volume of the ink drops ejected by the print head.

18. A method for detecting ink drops from a print head, comprising the steps of:

generating an electrical signal in response to each of a series of bursts of ink drops from the print head;

sensing and amplifying the electrical signals to generate an output signal at a frequency at which the bursts are ejected from the print head;

determining an amplitude of the output signal at the frequency by performing a digital signal processing function on the output signal such that the amplitude indicates a characteristic of the ink drops in each burst, wherein the step of determining the amplitude comprises the steps of digitizing the output signal to generate a data array and then matching the data array to a target waveform having the frequency.

19. The method of claim 18, wherein the target waveform is a sine wave.

20. The method of claim 18, wherein the target waveform is a square wave.

21. The method of claim 18, wherein the target waveform is an experimentally derived waveform that matches the frequency response of the sense amplifier.

22. The method of claim 13, wherein the step of determining the amplitude is performed with a preexisting processor and a preexisting analog-to-digital converter in a printer that contains the print head.

23. An ink drop detector, comprising:

sensing element which is imparted with an electrical stimulus when struck by a series of ink drop bursts ejected from a print head wherein the ink drop bursts occur in a predetermined pattern of frequencies;

sense amplifier which is tuned to a frequency response range which encompasses the predetermined pattern of frequencies, the sense amplifier generating an output signal in response to the ink drop bursts striking the sensing element;

processing means that determines an amplitude of the output signal at each frequency in the predetermined pattern of frequencies such that each amplitude provides a characterization of the ink drops in each corresponding burst.

24. The ink drop detector of claim 23, wherein the processing means determines the amplitudes by performing a digital signal processing function on the output signal at each frequency in the predetermined pattern of frequencies.

25. The ink drop detector of claim 23, wherein the predetermined pattern of frequencies is preselected to avoid erroneous results in the determination of the amplitudes which are caused by noise in the sense amplifier.

26. The ink drop detector of claim 23, wherein the processing means determines the amplitudes by digitizing the output signal to generate a data array for each frequency in the predetermined pattern and then matching each data array to a corresponding target waveform having a corresponding frequency in the predetermined pattern.

* * * * *